US007776459B2

(12) United States Patent
Schlichting et al.

(10) Patent No.: US 7,776,459 B2
(45) Date of Patent: Aug. 17, 2010

(54) HIGH SODIUM CONTAINING THERMAL BARRIER COATING

(75) Inventors: Kevin W. Schlichting, Storrs, CT (US); Michael J. Maloney, Marlborough, CT (US); David A. Litton, Rocky Hill, CT (US); Melvin Freling, West Hartford, CT (US); John G. Smeggil, Simsbury, CT (US); David Snow, Glastonbury, CT (US)

(73) Assignee: United Technologies Corporation, Hartford, CT (US)

( * ) Notice: Subject to any disclaimer, the term of this patent is extended or adjusted under 35 U.S.C. 154(b) by 764 days.

(21) Appl. No.: 11/506,687

(22) Filed: Aug. 18, 2006

(65) Prior Publication Data

US 2008/0044686 A1 Feb. 21, 2008

(51) Int. Cl.
*B32B 9/00* (2006.01)
*F01D 5/14* (2006.01)
*F01D 25/08* (2006.01)

(52) U.S. Cl. ..... 428/699; 428/701; 428/702; 416/241 R; 416/241 B

(58) Field of Classification Search ..... 416/241 R, 416/241; 428/689, 699, 701, 702, 704
See application file for complete search history.

(56) References Cited

U.S. PATENT DOCUMENTS

| | | | | |
|---|---|---|---|---|
| 6,194,084 | B1 * | 2/2001 | Wei et al. | 428/615 |
| 6,376,022 | B1 * | 4/2002 | Mallow et al. | 427/397.8 |
| 6,524,704 | B1 | 2/2003 | Wei et al. | |
| 6,544,665 | B2 | 4/2003 | Rigney et al. | |
| 6,558,814 | B2 | 5/2003 | Spitsberg et al. | |
| 2003/0003318 | A1 * | 1/2003 | Spitsberg et al. | 428/633 |
| 2004/0175597 | A1 * | 9/2004 | Litton et al. | 428/702 |

FOREIGN PATENT DOCUMENTS

| | | | |
|---|---|---|---|
| EP | 0 992 603 | A1 | 12/2000 |
| EP | 1 772 441 | A1 | 11/2007 |
| WO | 93/24672 | A1 | 12/1993 |

OTHER PUBLICATIONS

European Search Report, Reference 74.95951, Application No. 07253182.5-1215.

* cited by examiner

*Primary Examiner*—Gwendolyn Blackwell
(74) *Attorney, Agent, or Firm*—Bachman & LaPointe, P.C.

(57) ABSTRACT

A turbine engine component has a substrate and a thermal barrier coating deposited onto the substrate. The thermal barrier coating comprises a ceramic material having a sodium containing compound incorporated therein. The sodium containing compound is present in a concentration so that when molten sand reacts with the coating, sodium silicate is formed as the by product.

26 Claims, 1 Drawing Sheet

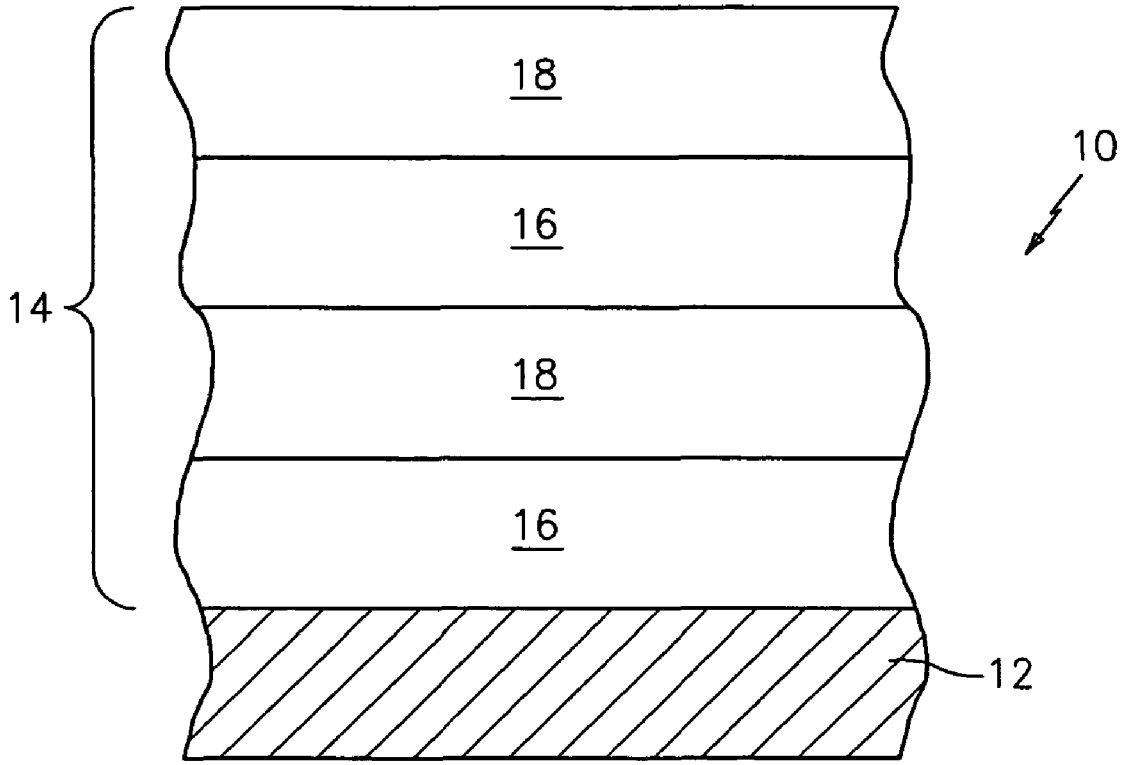
18
16
18
16
14
10
12

HIGH SODIUM CONTAINING THERMAL BARRIER COATING

BACKGROUND (1) Field of the Invention

The present invention relates to the use of thermal barrier coatings containing high concentrations of sodium containing compounds in the form of a dopant, second phase, or, as discrete layer(s) in the coating.

(2) Prior Art

Turbine engine airfoils used in desert environments may degrade due to sand related distress of thermal barrier coatings. The mechanism for such distress is the penetration of fluid sand deposits into 7YSZ ceramic thermal barrier coatings that leads to spallation and then accelerated oxidation of exposed metal. It has been observed that gadolinia stabilized zirconia coatings react with fluid sand deposits and a reaction product forms that inhibits fluid sand penetration into the coating. The reaction product has been identified as being a silicate oxyapatite/garnet containing primarily gadolinia, calcia, zirconia, and silica.

One way of improving airfoil efficiency is to reduce surface roughness. Sealant layers have been used to address this issue.

There remains a need however for a coating system which effectively deals with sand related distress.

SUMMARY OF THE INVENTION

In accordance with the present invention, a turbine engine component is provided which has a substrate and a thermal barrier coating with a sodium containing compound. The sodium containing compound in the thermal barrier coating is present in a concentration sufficient to create sodium silicate following reaction with molten sand.

In accordance with the present invention, a turbine engine component broadly comprises a substrate and a thermal barrier coating deposited onto the substrate. The thermal barrier coating comprises a ceramic material having sodium containing compound incorporated therein.

Further in accordance with the present invention, a thermal barrier coating broadly comprises a ceramic material having sodium containing compound incorporated therein.

Other details of the high sodium containing thermal barrier coating of the present invention, as well as other objects and advantages attendant thereto, are set forth in the following detailed description and the accompanying drawings wherein like reference numerals depict like elements.

BRIEF DESCRIPTION OF THE DRAWINGS

The FIGURE is a schematic representation of a thermal barrier coating system in accordance with the present invention.

DETAILED DESCRIPTION OF THE PREFERRED EMBODIMENT(S)

Referring now to the FIGURE, there is shown a turbine engine component 10 having a substrate 12, such as an airfoil portion or a platform portion of the component 10, and a thermal barrier coating 14 on at least one surface of the substrate 12. The substrate 12 may be formed from any suitable material known in the art such as a nickel based superalloy, cobalt based superalloy, refractory metal alloy, ceramic based material, or ceramic matrix composite.

The thermal barrier coating 14 may comprise one or more layers 16 of a ceramic material that may be selected from the group consisting of a zirconate, a hafnate, a titanate, and mixtures thereof. The ceramic material may be mixed with, and preferably contains, from about 5 to 99 wt %, preferably from about 30 to 70 wt %, of at least one oxide of a metal selected from the group consisting of lanthanum, cerium, praseodymium, neodymium, promethium, samarium, europium, gadolinium, terbium, dysprosium, holmium, erbium, thulium, ytterbium, lutetium, scandium, indium, and yttrium. In addition, the layer 16 may be a yttria stabilized zirconia material or a gadolinia stabilized zirconia material. The yttria stabilized zirconia material may contain from 1.0 to 25 wt % yttria and the balance zirconia. The gadolinia stabilized zirconia material may contain from 5.0 to 99 wt % with a preferred range of 30 to 70 wt % gadolina, and the balance zirconia.

The ceramic material layer(s) 16 may be deposited using any suitable method known in the art. The thermal barrier coating may further comprise one or more layers 18 of a sodium containing compound such as sodium oxide, sodium containing silicates, sodium containing titanates, etc. The sodium containing compound can be applied by known techniques such as sol-gel, slurry, chemical vapor deposition, sputtering, thermal spray, and electron beam physical vapor deposition (EB-PVD). When the sodium containing compound is present in one or more layers 18, it is preferred that the outermost layer of the thermal barrier coating 14 be a sodium containing compound layer 18. If desired, the thermal barrier coating 14 may have alternating ceramic and sodium containing compound layers 16 and 18.

In lieu of forming sodium containing compound layers, the sodium may be present in the ceramic material in the form of a dopant or a second phase. Such a coating may be formed by doping a zirconia based feedstock material with sodium. The coating could then be applied by known techniques such as sol-gel, slurry, chemical vapor deposition, sputtering, air plasma-spray, high velocity oxygen fuel (HVOF), and electron beam physical vapor deposition (EB-PVD). In addition, sodium containing compounds could be added during the deposition process as a second phase. For example, air plasma-spraying may involve co-spraying one or more sodium containing compounds and the zirconia base material.

The thermal barrier coatings 14 of the present invention incorporate enough sodium so that when molten sand reacts with the coating 14, sodium silicate is formed as the by product. Sodium silicate, otherwise known as waterglass, is water soluble and can be removed from turbine engine components during a water wash, thereby facilitating cleaning of the turbine airfoils. In accordance with the present invention, the thermal barrier coatings may contain a concentration of the sodium containing compound in the range of from about 0.5 to 50 wt %, preferably from about 10 to about 30 wt %.

A bond coat may be provided between the substrate 12 and the thermal barrier coating 14. The bond coat can be a MCrAlY, an aluminide, a platinum aluminide, a ceramic or a silica based bond coat.

A top coat may be applied over the thermal barrier coating by known techniques such as sol-gel, slurry, chemical vapor deposition, sputtering, plasma-spray, high velocity oxygen fuel (HVOF), and electron beam physical vapor deposition (EB-PVD). The top coat may be selected from the group consisting of a sodium containing compound, an oxyapatite, a garnet, and mixtures thereof.

One of the benefits of the present invention is a thermal barrier coating system that will facilitate cleaning of previously molten sand from turbine components. By removing the solidified sand, further penetration into the thermal barrier coating and subsequent damage due to thermal cycling will be reduced. In addition, airfoil efficiency will be improved due to reduced surface roughness.

While the coating system of the present invention was developed for use primarily as a thermal barrier coating, it may also be desirable to deposit the material, with a desired degree of porosity, for use as a seal. See, e.g., commonly owned U.S. Pat. No. 4,936,745, which is expressly incorporated by reference herein. An example would be the incorporation of polymer material into gadolinia zirconia oxide, with subsequent application by thermal spray and heat treatment to thereby generate pores in the ceramic. In such a case, the coating preferably has a porosity of between about 30-60 vol. %.

It is apparent that there has been provided in accordance with the present invention a high sodium containing thermal barrier coating which fully satisfies the objects, means, and advantages set forth hereinbefore. While the present invention has been described in the context of specific embodiments thereof, other unforeseeable alternatives, modifications and variations may become apparent to those skilled in the art having read the foregoing description. Accordingly, it is intended to embrace those alternatives, modifications, and variations as fall within the broad scope of the appended claims.

What is claimed is:

1. A turbine engine component comprising:

a substrate;

a thermal barrier coating deposited onto said substrate;

said thermal barrier coating comprising at least one interior layer of a ceramic material and an exterior layer deposited on said at least one interior layer, said exterior layer consisting of a sodium containing compound selected from the group consisting of sodium oxide, sodium silicate and sodium titanate.

2. The turbine engine component according to claim 1, wherein said thermal barrier coating further comprises additional layers of said ceramic material and at least one additional layer containing a sodium compound selected from the group consisting of sodium silicate, sodium oxide, and sodium titanate, and said ceramic material layers alternating with said layers containing said sodium compound.

3. The turbine engine component according to claim 1, wherein said sodium containing compound is sodium oxide.

4. The turbine engine component according to claim 1, wherein said substrate is an airfoil portion.

5. The turbine engine component according to claim 1, wherein said substrate is formed from a nickel based superalloy, a cobalt based superalloy, a refractory metal alloy, a ceramic based material, or a ceramic matrix composite.

6. The turbine engine component according to claim 1, wherein said ceramic material comprises a yttria stabilized zirconia.

7. The turbine engine component according to claim 6, wherein said yttria stabilized zirconia consists of from 1.0 to 25 wt % yttria and the balance zirconia.

8. The turbine engine component according to claim 1, wherein said ceramic material comprises a gadolinia stabilized zirconia consisting of from 5.0 to 99 wt % gadolinia and the balance zirconia.

9. The turbine engine component according to claim 8, wherein said gadolinia stabilized zirconia consists of from 30 to 70 wt % gadolinia and the balance zirconia.

10. The turbine engine component according to claim 1, wherein said ceramic material is selected from the group consisting of a zirconate, a hafnate, a titanate, and mixtures thereof.

11. The turbine engine component according to claim 10, wherein the ceramic material is mixed with from about 5 to 99 wt % of at least one oxide of a metal selected from the group consisting of lanthanum, cerium, praseodymium, neodymium, promethium, samarium, europium, gadolinium, terbium, dysprosium, holmium, erbium, thulium, ytterbium, lutetium, scandium, indium, and yttrium.

12. The turbine engine component according to claim 11, wherein said at least one oxide is present in an amount from 30 to 70 wt %.

13. The turbine engine component according to claim 1, further comprising a bond coat between said substrate and said thermal barrier coating.

14. A coating system for use with turbine engine components comprising at least one interior layer of a ceramic material and an exterior layer distinct from said at least one interior layer, said exterior layer consisting of a sodium containing compound selected from the group consisting of sodium oxide, sodium silicate and sodium titanate.

15. The coating system according to claim 14, wherein said coating system further comprises additional layers of said ceramic material and at least one additional layer containing a sodium compound selected from the group consisting of sodium silicate, sodium oxide, and sodium titanate, and said ceramic material layers alternating with said layers containing said sodium compound.

16. The coating system according to claim 14, wherein said coating system comprises alternating layers of a ceramic material and distinct layers of sodium oxide.

17. The coating system according to claim 14, wherein said ceramic material comprises a yttria stabilized zirconia.

18. The coating system according to claim 17, wherein said yttria stabilized zirconia consists of from 1.0 to 25 wt % yttria and the balance zirconia.

19. The coating system according to claim 14, wherein said ceramic material comprises a gadolinia stabilized zirconia consisting of from 5.0 to 99 wt % gadolinia and the balance zirconia.

20. The coating system according to claim 19, wherein said gadolinia stabilized zirconia consists of from 30 to 70 wt % gadolinia and the balance zirconia.

21. The coating system according to claim 14, wherein said ceramic material is selected from the group consisting of a zirconate, a hafnate, a titanate, and mixtures thereof.

22. The coating system according to claim 21, wherein the ceramic material is mixed with from about 5.0 to 99 wt % of at least one oxide of a material selected from the group consisting of lanthanum, cerium, praseodymium, neodymium, promethium, samarium, europium, gadolinium, terbium, dysprosium, holmium, erbium, thulium, ytterbium, lutetium, scandium, indium, and yttrium.

23. The coating system according to claim 22, wherein said at least one oxide is present in an amount from 30 to 70 wt %.

24. A turbine engine component comprising:

a substrate;

a thermal barrier coating deposited onto said substrate; and said thermal barrier coating consisting of: a ceramic material selected from the group consisting of a zirconate, a hafnate, a titanate, and mixtures thereof; from about 0.5 to 50 wt % of a sodium containing compound selected from the group consisting of sodium silicate and sodium titanate; and from about 5 to 99 wt % of at least one oxide of a material selected from the group consisting of lanthanum, cerium, praseodymium, neodymium, promethium, samarium, europium, gadolinium, terbium, dysprosium, holmium, erbium, thulium, ytterbium, lutetium, scandium, indium, and yttrium.

25. The turbine engine component of claim 24, wherein said sodium containing compound is present in an amount from 10 to 30 wt %.

26. The turbine engine component of claim 24, wherein said at least one oxide is present in an amount from 30 to 70 wt %.

* * * * *